United States Patent [19]

Laauwe

[11] 3,990,640

[45] *Nov. 9, 1976

[54] ACTUATOR FOR AEROSOL VALVE STEMS

[76] Inventor: Robert H. Laauwe, 237 Green Ridge Road, Franklin Lakes, N.J. 07417

[ * ] Notice: The portion of the term of this patent subsequent to Oct. 21, 1992, has been disclaimed.

[22] Filed: Dec. 20, 1974

[21] Appl. No.: 535,082

[52] U.S. Cl. ..... 239/533; 222/402.11; 239/583

[51] Int. Cl.[2] ..... B05B 1/12; B65D 83/14

[58] Field of Search ..... 239/337, 533, 534, 469, 239/585, 571, 583; 222/399, 398, 533, 534, 525, 402.1—402.13

[56] References Cited

UNITED STATES PATENTS

| | | | |
|---|---|---|---|
| 3,053,461 | 9/1962 | Inglis | 239/533 X |
| 3,393,873 | 7/1968 | Larson | 239/583 X |
| 3,437,270 | 4/1969 | Venus, Jr. | 239/534 X |
| 3,545,682 | 12/1970 | Beard | 239/469 |
| 3,802,626 | 4/1974 | Regneault et al. | 239/533 X |
| 3,913,804 | 10/1975 | Laauwe | 222/402.11 |

*Primary Examiner*—Allen N. Knowles
*Assistant Examiner*—Norman L. Stack, Jr.
*Attorney, Agent, or Firm*—Kenyon & Kenyon Reilly Carr & Chapin

[57] ABSTRACT

An aerosal valve stem actuator of the anti-clogging type which has a valve opened by a flexible diaphragm having a skirt seal which seals more tightly by receiving the pressure of a dispensed pressurized product which not only flexes the diaphragm to the valve, but also presses the skirt seal outwardly against a cylinder in which the skirt seal is positioned.

3 Claims, 10 Drawing Figures

7
6
2
2a
4
1
3
5

16
31
A
30
31
30

16
9
6

A
16a

ACTUATOR FOR AEROSOL VALVE STEMS

BACKGROUND OF THE INVENTION

This invention relates to the actuators or buttons applied to the aerosol valve stems of aerosol packages in particular.

The science and technology of such packages and their components are described by the text "Aerosols: Science and Technology", published by Interscience Publishers, Inc., New York, copyrighted 1961, the entire contents of this text being hereby incorporated by this reference into the present application.

The prior art has recognized that such actuators involve the problem of clogging and has made various attempts at solving this problem as exemplified by the following U.S. patents McKernan Pat. No. 3,250,474, dated May 10, 1966
Barker Pat. No. 3,378,205, dated Apr. 16, 1968
Venus, Jr. Pat. No. 3,427,270, dated Apr. 8, 1969
Lewiecki et al. Pat. No. 3,428,223, dated Feb. 18, 1969
Beard Pat. No. 3,545,682, dated Dec. 8, 1970
Grothoff Pat. No. 3,602,407, dated Aug. 31, 1971

None of the constructions of the above patents have ever been applied to commercial aerosol packages, insofar as is known. They all have inherent disadvantages.

One disadvantage is that when any such actuator receives the pressurized product from the aerosol valve stem of an aerosol package, unsealing its orifice, the pressure drop occurring within the actuator adjacent to the actuator's orifice, causes the orifice to become resealed, this action occurring repeatedly with great rapidity to produce a chattering action. This follows from the fact that all anti-clogging or self-sealing actuators rely on the pressure of the product for unsealing, this pressure acting against a piston area provided in one way or another, and against some form of elastic means normally biasing the valve arrangement involved to a normally closed position sealing the actuator's orifice so that product trapped within the actuator is sealed against the atmosphere which might otherwise solidify the product within the actuator.

Such actuators are necessarily very small in dimensions and another disadvantage has been that the prior art actuators have involved parts which cannot be easily injection molded as plastic parts capable of assembly by mass production methods, keeping in mind the very large quantities of aerosol packages involved by the production of any one kind of package.

Even conventional actuators which do involve the clogging problem and which are of one-piece construction and capable of being injection molded in the large quantities required, have the disadvantage, shared by the non-clogging actuator proposals, that the discharge rate is unvariably fixed by the discharge orifice diameter. In many instances, it would be desirable to be able to vary the discharge rate and spray characteristics of an aerosol package, under control by the user of the package.

A non-clogging aerosol valve stem actuator, sometimes called a button, which is free from the disadvantages described above, is disclosed and claimed in the U.S. Laauwe patent application Ser. No. 490,077, filed July 19, 1974, on which U.S. Pat. No. 3,913,804, issued Oct. 21, 1975.

That application discloses an aerosol valve stem actuator comprising a substantially rigid plastic body having a hole formed upwardly therein for receiving the stem and a passage formed through the body transversely with respect to the stem hole and into which that hole opens. The body forms a front end wall closing the adjacent or front end of the passage, this front end wall having a discharge orifice formed through it, the passage having a back end portion forming a cylinder which contains a substantially rigid slidable plastic reciprocating piston positioned in the cylinder and having a piston rod extending forwardly with a front end engaging the body's front end wall around the orifice and normally closing the orifice when the piston is at an advanced position and separating from the front end wall, to unseal the orifice, when the piston is at retracted positions.

The body has an external back end surface surrounding the back end of the cylinder and having screw threads, a product discharge governor formed by a cap having a side wall with internal screw threads being screwed on the screw threads of this surface. This cap has an internal abutment surface engaged by the piston when in its retracted position and adjustably fixing this position dependent on the position of the cap. A coil compression spring connects with the inside of said cap and extends forwardly and connects to the piston to bias the piston to its advanced position with its piston rod front end engaging the body's front end wall around the orifice and normally closing and sealing the orifice.

The actuator's piston and piston rod form a piston area facing the body's front end, and having a flow rate capacity at the pressure and constituancy of the product, relatively proportioned to maintain the pressure applied to the piston at a value holding the piston at its retracted position continuously as long as the product flows through the passage and through the dispensing orifice. The valve stem hole opens transversely into the body's passage at a location spaced far enough backwardly from the orifice and towards the piston for the latter to be continuously forced to its retracted position constantly during maintenance of the product flow.

The front end of the piston rod and the inside of the body's front end wall respectively have male and female slidingly interfitting elements, such as vanes or baffles, contoured substantially as curved segments to form a swirl chamber, the side edges of these segments being interspaced to form side orifices or openings when the piston rod is retracted more or less, depending on the governor. The piston rod and the inside of the surface of the body's passage have slidably interfitting guide elements holding the piston rod and piston against rotation when the governor is screwed rotatively to govern the product discharge.

All of the parts of the above described earlier Laauwe actuator are made of substantially rigid plastic, excepting for the possible use of a metal spring to bias the actuator to its normally closed position. Prototypes of that actuator have been made by using plastic injection molding techniques to form the plastic parts. The reciprocating piston and the cylinder in which it reciprocates can be made to interfit adequately to avoid appreciable leakage between the piston and the cylindrical wall, when the actuator is used. The production of the prototype has proven that the necessary interfitting can be accomplished under commercial large-quantity production conditions.

SUMMARY OF THE INVENTION

A modified form of the Laauwe acutator is the subject matter of the Laauwe U.S. Pat. No. 3,913,803, issued Oct. 21, 1975. This patented construction also uses a substantially rigid reciprocating piston.

The object of the present invention is to provide an actuator having at least all of the advantages of the Laauwe actuator described hereinabove, but eliminating the need for the sliding substantially rigid reciprocating piston.

According to the present invention, this is done by using substantially the same construction as before but with the piston replaced by a flexible diaphragm having substantially the contour of the reciprocating substantially rigid piston which includes a peripheral inwardly extending skirt fitting the cylindrical wall. In effect, the former reciprocating piston is, according to the present invention, made of substantially flexible material in the sense that flexure exists under operating conditions of the actuator. Being flexible, what was before a piston head, becomes the flexible diaphragm referred to, a rod like the former piston rod, extending inwardly from the central portion of this flexible diaphragm or wall, to the former relationship with the actuator body's discharge orifice in the front wall of the actuator body. The peripheral piston skirt is, however, firmly fixed against displacement in an axial direction, but, of course, being easily flexed radially outwardly by the product pressure when the actuator is actuated, to provide for very positive leak-proof sealing.

A modified form of governor is provided, but it performs the same function as before.

The new easily flexible piston with its skirt, and the rod which projects forwardly to act as a probe for closing and opening the actuator's discharge orifice, may all be made of the same flexible material and be an integral part or unit because the plastic may be made rigid enough for the rod to operate effectively but flexible enough for the diaphragm to flex under the product pressure when the actuator is actuated. In addition, the rod may be made tubular, as required to receive the metal spring previously referred to, while the diaphragm portion may be made with a relatively thin wall thickness. The pressure on the rod or probe is compressive and tends to rigidify the rod portion, whereas the product pressure on the diaphragm part with its skirt, represents a force that is substantially normal or at right angles to what are relatively thin-walled portions. These factors all contribute to making possible the substantial reduction in rigidity, and, therefore, providing adequate flexibility, of the substantially rigid plastic used for making the earlier Laauwe actuator.

BRIEF DESCRIPTION OF THE DRAWINGS

The presently preferred mode for carrying out the present invention is schematically illustrated by the accompanying drawings, in which.

DETAILED DESCRIPTION OF THE INVENTION

Figure 1:
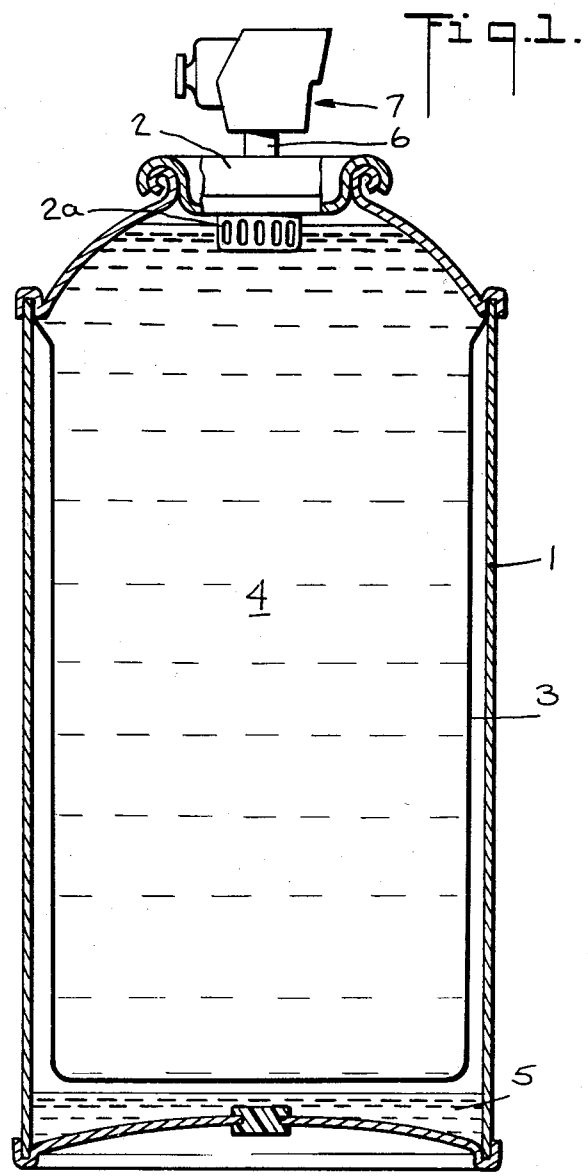
FIG. 1 is a vertical section showing an aerosol product package to which this new actuator is applied.

As illustrated, the aerosol package shown by FIG. 1 comprises the usual can body 1 having what may be a conventional valve 2 and, in this case, an easily deformable flexible bag 3 which contains the product 4, the product being pressurized by vapor between the bag 3 and the can 1, generated by a small pool of propellant 5 shown in the bottom of the can. The valve shown is of the type having an intake formed by a shell 2*a* containing a number of perforations, to avoid intake clogging by the collapsing bag 3 as the product is pressed from the bag by the vapor pressure. An example of such a package is one made by using the "Power Flo" type of container, made substantially as shown by the U.S. Bruce et al. U.S. Pat. No. 3,392,842, dated July 23, 1968. The "Sepro" type of container could also be used, made substantially as shown by the Krizka U.S. Pat. No. 3,433,391, dated Mar. 18, 1969. However, the new actuator may be used either as an actuator or as an attachment in the case of any package ejecting a pressurized fluid product, in the sense that the product is under pressure, for example, by actuation of a finger or hand-operated mechanical pump. Normally the actuator would be used on the valve stem of an aerosol package containing a product pressurized directly or indirectly by a suitable aerosol propellant.

The aerosol valve 2 is shown with the usual tubular valve stem 6 through which the pressurized product discharges when the stem is depressed to open the valve 2.

Figure 2:
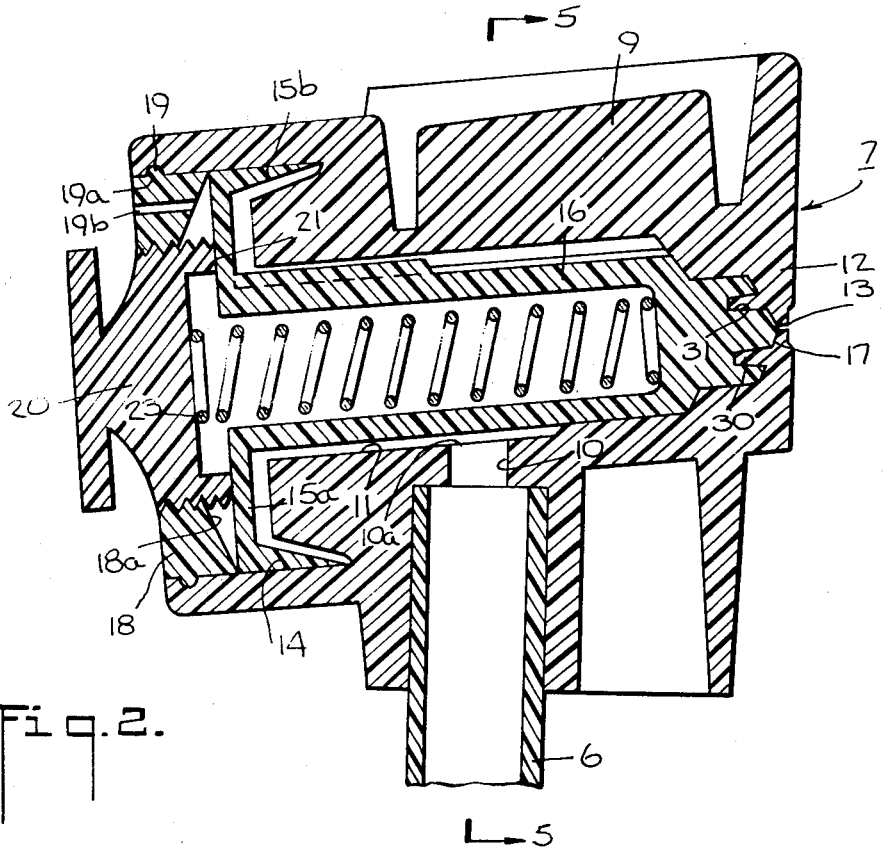
FIG. 2 is a vertical section through the actuator itself showing the governor locking the actuator against inadvertent discharge.
Figure 3:
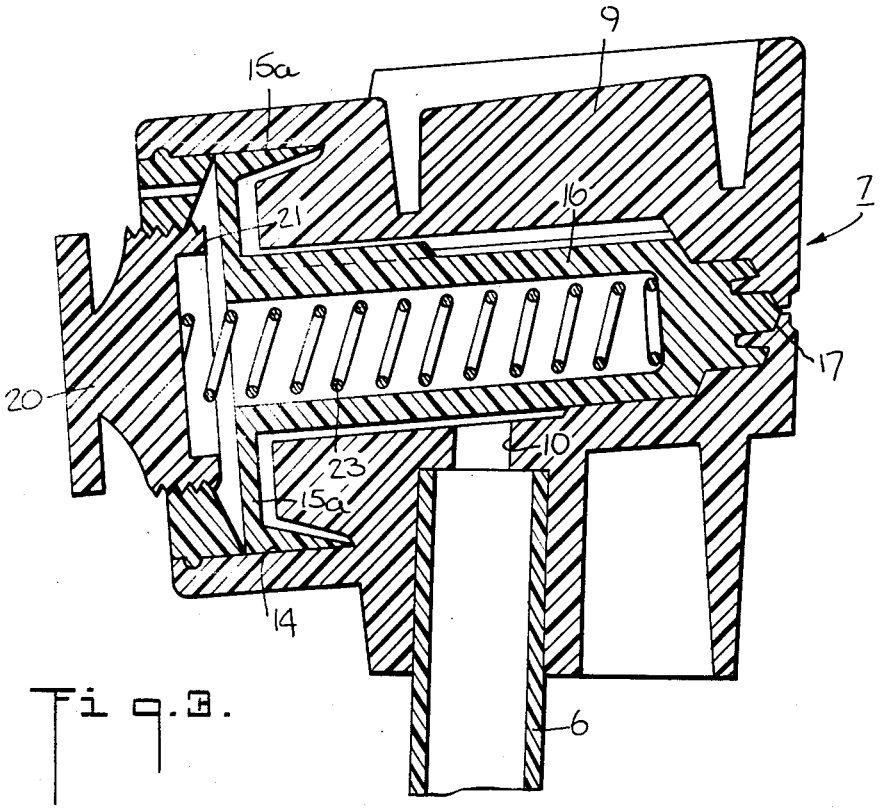
FIG. 3 is the same as FIG. 2 but showing the governor released so that the actuator is prepared for use.
Figure 4:
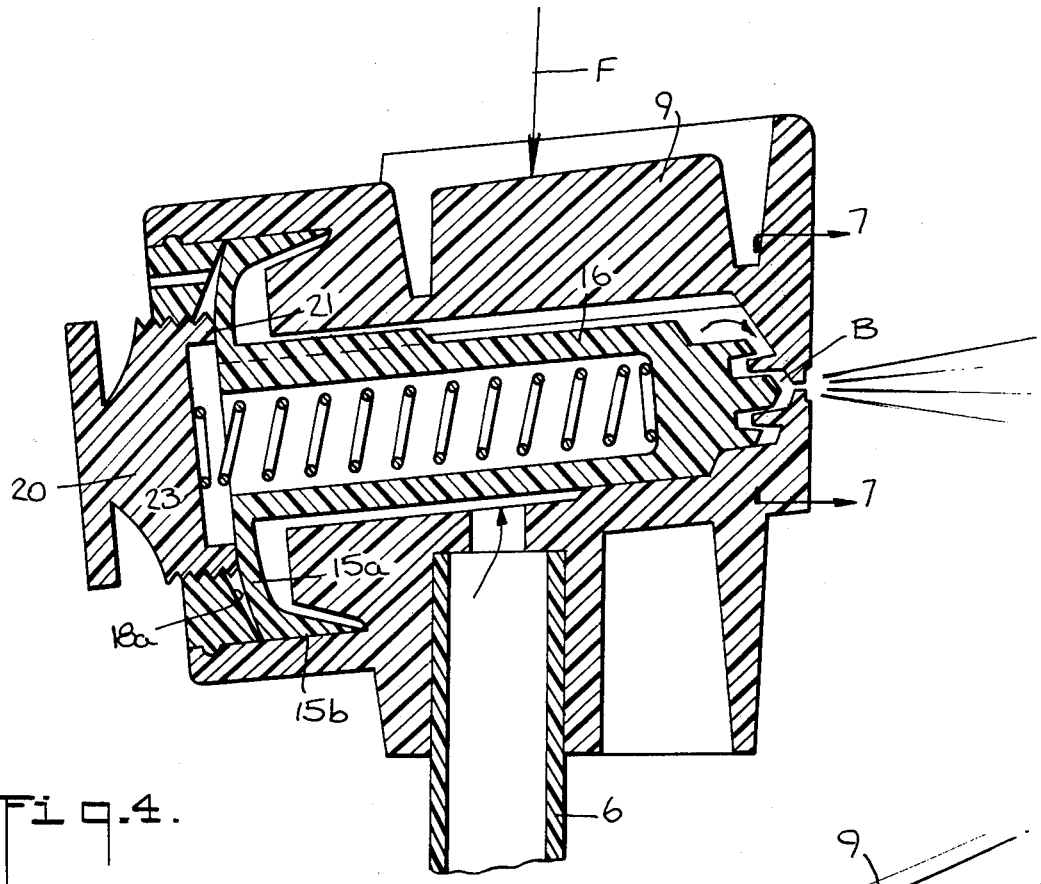
FIG. 4 is again the same as FIG. 3 but, with considerable exaggeration for illustrative purposes, shows the actuator parts during the dispensing or discharging of the packaged product under pressure.
Figure 6:
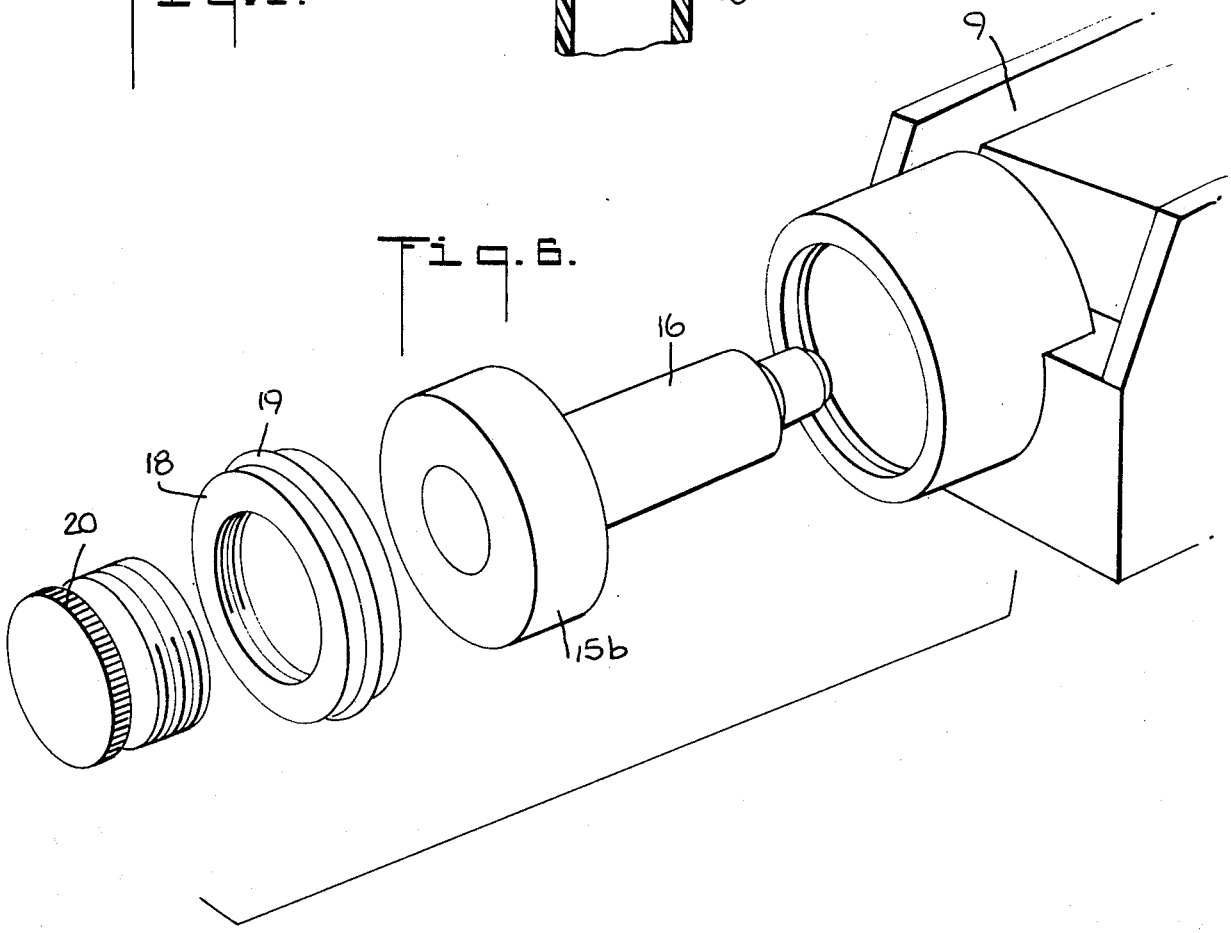
FIG. 6 is an exploded view showing the manner in which the actuator parts can be assembled, and if desired, disassembled.

Referring to FIGS. 2 through 4, the actuator or button 7, shown in FIG. 1 for use when depressing the valve stem 6, comprises a substantially rigid plastic body 9 having the hole 10 formed upwardly in the body for receiving the valve stem 6 with the usual press fit. The body 9 has the horizontal passsage 11 formed through it transversely with respect to the axis of the hole 10 and into which this hole opens at 10*a*. The actuator body has a front end wall 12 closing the front end of the passage 11 and it is in this wall that the discharge orifice 13 is formed. The diameter of this orifice may be in the area of from about 0.002 to about 0.050 inches, but its exact diameter depends on the type of formulation dispensed and the delivery or discharge effect desired.

The back or left-hand portion of the passage 11 is enlarged to form a cylinder 14 and this cylinder within its side wall contains the flexibly deformable diaphragm and skirt which, excepting for being non-reciprocative, corresponds to the rigid reciprocating piston of the earlier Laauwe actuator. Thus, in this case, a flexible wall or annulus 15*a* closes the cylinder 14 with respect to the passage 11 and this diaphragm peripherally has a forwardly extending skirt 15*b* facing in the direction of the pressure introduced to the actuator body by way of the opening 10, when the actuator is actuated. This skirt 15*b* tapers forwardly in wall thickness and, like the diaphragm 15*a*, is flexible under the force of the fluid product being dispensed through the actuator. This diaphragm and skirt has, extending centrally forwardly from the diaphragm, a rod or elongated member or probe 16 having a front end 17 engaging the inside of the front end wall 12 on its surface around the orifice 13. This forward piston rod end 17 seals the orifice 13 fluid-tightly and air-tightly closed when the rod 16 is at a normal or advanced position with the diaphragm portion 15*a* being substantially unflexed. When the diaphragm 15*a* receives the product of the pressure, it can deflect or flex backwardly so that the rod end 17 unseals the orifice 13.

In the case of the present invention, the diaphragm 15*a* and its skirt 15*b* and the rod 16 with all of its parts, are formed by a single integral unit made of plastic which is flexible to the degree that the diaphragm 15*a* can flex under the pressure of the product being dispensed, to retract the rod or probe 16 as required to open the orifice 13 which is normally closed by the front end of this rod.

The entire actuator, other than the possible use of a metal spring described hereinafter, may be made of any of the plastics conventionally used to make prior art actuators. Examples are polyethelene, nylon, polypropylene and the like. When such plastics do not include a substantial amount of any of the plasticizers used for their manufacture, they are substantially rigid. The inclusion of plasticizers in adequate proportions, results in such plastics becoming more and more flexible, depending on the proportioning. In the present instance, the actuator body 9 may be made of such plastics using either none or a small amount of plasticizers. In the case of the diaphragm parts 15*a* dnd 15*b*, and the integral rod or probe 16, the plastics used should be compounded with a greater amount of plasticizer, as required to produce a balanced flexibility insuring that the rod portion 16 is a structurally stable element while the relatively thin-walled diaphragm 15*a* and its sealing skirt 15*b*, are appreciably flexible when subjected to the pressure of the pressurized product being dispensed through the actuator. Proper formulation, in conjunction with adjustment of the wall thickness of the diaphragm 15*a* and its skirt 15*b*, can assure a balanced flexibility permitting the various parts to perform their intended functions.

As previously indicated, the periphery of the diaphragm 15*a* and, of course, includng its skirt 15*b*, are locked positively agiinst axial displacement. This is done by an annular retainer 18 having a peripheral rib 19 snapped into an annular groove 19*a* formed on the inside of the cylindrical portion 14 formed in the back end of the actuator body. This retainer is formed with a vent 19*b* for the back end of the diaphragm 15*a*, and it is internally screw-threaded to receive the previously described governor which in this case is an externally threaded governor body plug 20 which by screw action can be moved back and forth. This plug has an annular abutment 21 with an inner end engaging the diaphragm 15*a* adjacently opposite to the rod 16 which, being tubular, may contain the metal compression spring 23 which biases the rod 16 forwardly to its normally closed position. If the diaphragm 15*a* is springy, it alone may provide the spring action.

As described so far, when the actuator is pressed so that the pressurized product discharges through the opening or hole 10 into the passage 11, the pressure reaches the diaphragm 15*a* and flexes it backwardly, the diaphragm's peripheral skirt 15*b* remaining stationary because held by the annular retainer 18. This retainer 18 flares inwardly, as at 18*a*, to permit the diaphragm to flex backwardly in a free manner. The rod 16 is thus retracted to open the orifice 13, the product then discharged, and upon release of the actuator finger pressure, closing the aerosol valve, the spring 23, or the diaphragm possibly, then promptly moving the rod 16 forwardly so that its end 17 closes the orifice 13 to provide protection against possible clogging due to evaporation and crystallization of the product components.

In FIG. 2 the actuator is shown with the governor 20 screwed in so that its annular abutment 21 prevents the diaphragm 15*a* from backwardly flexing, thus locking the actuator closed. The variously available child-proof arrangements may be applied to the actuator plug 20 to prevent it from being unscrewed by children. To place the actuator in a ready condition, the plug 40 is screwed outwardly or backwardly so that, as shown by FIG. 3, the governor's annular abutment surface 21 is free from the flexible diaphragm 15*a*. In FIG. 4 the actuator is shown with finger pressure applied, as at F, this opening the aerosol valve and the pressurized product flexing the diaphragm 15*a* backwardly to retract or withdraw the rod or probe 16 to open the orifice 13.

In the foregoing way the advantages of the earlier Laauwe actuator are all retained while the receprocating piston of that actuator is eliminated and replaced by the flexible diaphragm having its periphery locked against reciprocating motion and using only the flexing of the diaphragm for the actuator operation and possibly as the spring. No sliding parts are involved. The diaphragm skirt being made of the same relatively flexible plastic as is the diaphragm, need not fit the cylindrical portion 14 with any substantial precision at all because this skirt, being flexibly deformable is expanded by the product pressure into a tight seal with the inside of the wall of the cylinder 14. Because the rod or probe 16 may be tubular, the fluid pressure is applied to this tubular rod to place the latter under radial compression, thus inherently stiffening the rod or probe and increasing its rigidity beyond that to be expected from the plasticized plastic required to provide the flexibility for the diaphragm 15*a* and its skirt 15*b*.

To provide a swirl chamber, the inside of the actuator body's front wall 12, surrounding the orifice 15, is provided with backwardly projecting vanes or baffles 30, forming male elements, which in cross section have the contour of spiral or arcuate or curved segments with ends which either overlap or are spaced adjacent to each other, and in the case of FIGS. 2 through 4, the front end of the rod or probe 16 is shown as having recesses 31, or female elements, of corresponding shape in which the baffle vane segments 30 fit with a sliding fit which is substantially fluid-tight.

Figure 7:
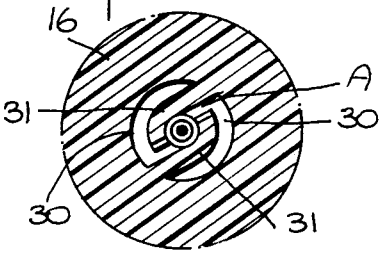
FIG. 7 is a cross section taken on the line 7—7 in FIG. 4.
Figure 5:
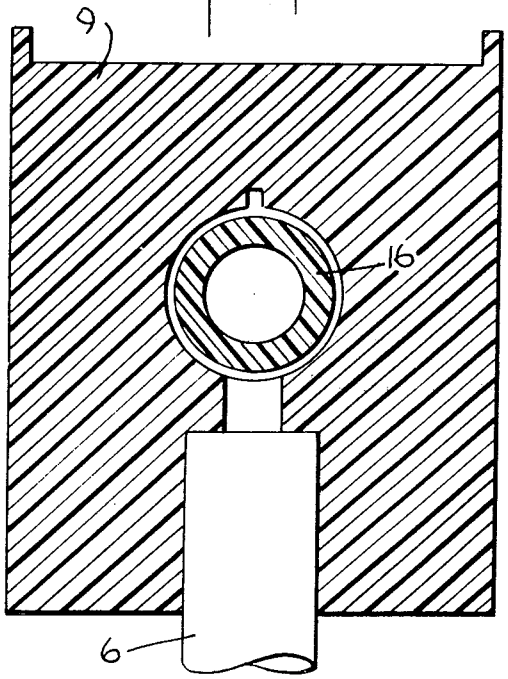
FIG. 5 is a cross section taken on the line 5—5 in FIG. 2.
Figure 8:
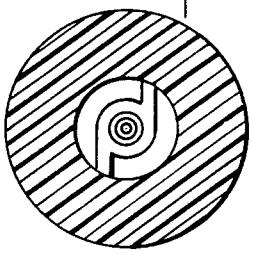
FIG. 8 is the same as FIG. 7 but shows a first modification.
Figure 9:
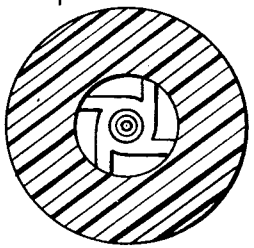
FIG. 9 is the same as FIG. 7 but shows a second modification.
Figure 10:
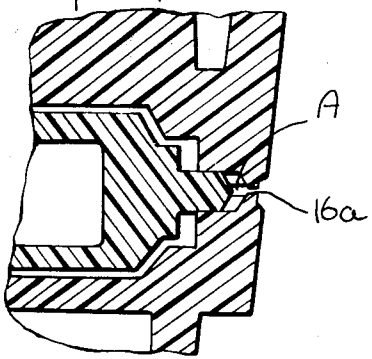
FIG. 10 in vertical cross section shows a modification of the front end of the rod or probe which determines the nature of the discharge provided by the actuator through its discharge orifice.

The ends of the baffles 30, in cooperation with the female parts of the front end of the rod or probe 16, form side entrances A so that as the rod or probe is retracted, these side entrances open as lateral or transverse orifices which discharge into the space B within the male elements or vanes. In this way small lateral or transverse orifices discharge the product into this chamber B which functions as a pre-expansion or first-stage expansion chamber, the product swirling within this space while expanding, after which it discharges through the orifice 13. If the ultimate action of this type if not desired, the skirts defining the female elements on the front end of the rod 16 may be eliminated as indicated in FIG. 10. FIGS. 8 and 9 show alternate forms of the FIG. 7 arrangement.

Whether or not the skirts defining the female elements or recesses in the front end of the rod 16 are present or absent, as the front rod portion 16*a* is withdrawn from between the two baffles or vanes having their respective side ends mutually interspaced, one or more orifices leading into the pre-expansion shcmber space B are opened, the pressurized product fluid ejecting into this chamber for preliminary expansion, after which it is ejected through the discharge orifice. The size of the lateral orifice or orifices which eject into this pre-expansion chamber or space, is determined by the setting of the governor or plug 20.

Because of this preliminary stage of expansion effected as described above, and because it is effected through one or more variable area introductory orifices, controlled by the governor, with the product thereafter discharging through the actuator's discharge orifice, it is believed possible to provide a practical aerosol package which discharges none or relatively very little of propellant into the atmosphere. For example, using the type of package illustrated by FIG. 1 of the drawings, the propellant 5 may be entirely separated from the product 4 and the latter need not contain propellant to obtain a spray which, by adjustment of the governor, can vary from an extremely fine and possibly truly aerosol dispersion to what is substantially a solid stream of undispersed product. Such a solid stream can be obtained by full retraction of the governor so that the product is ejected through the lateral orifices resulting from the use of the vanes or baffles previously described, in the form of solid liquid which completely fills the pre-expansion or swirl chamber formed by the previously described construction, and this chamber or space being filled with solid liquid, the products ejecting as solid liquid jet through the discharge orifice. By adjustment of the governor, the size of the opening or openings formed as the rod is very slightly retracted when the actuator is activated, results in a lateral or transverse orifice or orifices of such small size that the pressurized product is caused to initially expand as contrasted to solidly filling the preliminary expansion space, the product thus being ejected through the discharge orifice as an extremely fine dispersion of droplets, possibly approaching a true aerosol dispersion.

What is claimed is:

1. An aerosol dispensing stem actuator comprising a substantially rigid plastic body having a dispensing stem hole formed upwardly therein for receiving an aerosol dispensing stem and a passage formed transversely with respect to said hole and into which said hole opens, said body forming a front end wall closing a front end of said passage, said front end wall having a discharge orifice formed therethrough, said passage having a back end portion forming a cylinder, a substantially flexible diaphragm positioned in said cylinder and integrally having a periphery formed by a forwardly extending and externally cylindrical skirt seal positioned in and substantially fitting the wall of said cylinder and having an inside annular surface exposed to pressure received in said passage from said dispensing stem hole, said skirt seal being substantially flexible radially so that said pressure forces the skirt seal against the cylinder's wall, means for holding said diaphragm and its skirt against axial movement in said cylinder, a rod extending forwardly from a central portion of said diaphragm and having a front end engaging the inside of said front end wall around said orifice and closing said orifice when said diaphragm is flexed to an advanced position and retracting from said front end wall when said diaphragm is at a retracted position, said body having a back end surface behind the back end of said cylinder, said surface having screw threads, and a product discharge governor having screw threads and in screw-threaded engagement with the screw threads of said surface, said governor having an internal abutment surface engaged by the back of said diaphragm when the diaphragm is in its retracted position and adjustably fixing said position dependent on the position of said governor.

2. The actuator of claim 1 in which said skirt seal decreases in wall thickness forwardly from said diaphragm.

3. The actuator of claim 1 in which the front end of said rod and the inside of said front end wall respectively have axially slidingly interfitting elements cooperatively forming a chamber having at least one tangential inlet orifice connecting with said passage, the volume of said chamber and the cross-sectional area of said orifice being dependent on the retracted position of said diaphragm as adjustably fixed by said governor.

* * * * *